US008616670B2

(12) United States Patent
Kagose et al.

(10) Patent No.: US 8,616,670 B2
(45) Date of Patent: Dec. 31, 2013

(54) IMAGE FORMING METHOD AND INK JET RECORDING DEVICE

(75) Inventors: Taketoshi Kagose, Shiojiri (JP); Satoru Miura, Matsumoto (JP)

(73) Assignee: Seiko Epson Corporation (JP)

( * ) Notice: Subject to any disclaimer, the term of this patent is extended or adjusted under 35 U.S.C. 154(b) by 315 days.

(21) Appl. No.: 13/074,152

(22) Filed: Mar. 29, 2011

(65) Prior Publication Data

US 2011/0242183 A1 Oct. 6, 2011

(30) Foreign Application Priority Data

Mar. 30, 2010 (JP) ..... 2010-077775
Sep. 3, 2010 (JP) ..... 2010-198048

(51) Int. Cl.
*B41J 29/38* (2006.01)
*B41J 2/01* (2006.01)

(52) U.S. Cl.
USPC ..... 347/16; 347/101; 347/102

(58) Field of Classification Search
USPC ..... 347/16, 101, 102
See application file for complete search history.

(56) References Cited

U.S. PATENT DOCUMENTS

| | | | | |
|---|---|---|---|---|
| 6,312,123 | B1 | 11/2001 | Codos et al. | |
| 7,073,901 | B2 * | 7/2006 | Mills et al. | 347/102 |
| 7,988,259 | B2 * | 8/2011 | Hishida et al. | 347/51 |
| 8,123,346 | B2 * | 2/2012 | Ohnishi et al. | 347/102 |
| 8,142,009 | B2 * | 3/2012 | Hishida et al. | 347/102 |
| 8,215,761 | B2 * | 7/2012 | Takezawa et al. | 347/102 |
| 2004/0141040 | A1 | 7/2004 | Nakajima | |
| 2007/0058021 | A1 | 3/2007 | Kusunoki | |

FOREIGN PATENT DOCUMENTS

| | | | |
|---|---|---|---|
| EP | 2 106 918 | A1 | 10/2009 |
| JP | 2003-211651 | A | 7/2003 |
| JP | 4147943 | B | 7/2003 |
| JP | 2004-216681 | A | 8/2004 |
| JP | 2007-276248 | A | 10/2007 |

OTHER PUBLICATIONS

Extended European Search Report for Application No. 11160185.2 dated Dec. 3, 2012 (4 pages).
JP2003-211651A_Abstract and Machine English Trans.
JP4147943B(=JP2004-216681A)_Abstract and Machine English Trans.
JP2007-276248A_Abstract and Machine English Trans.

* cited by examiner

*Primary Examiner* — Laura Martin
*Assistant Examiner* — Jeremy Bishop
(74) *Attorney, Agent, or Firm* — Harness, Dickey & Pierce, P.L.C.

(57) ABSTRACT

An image forming method, including: a first process for ejecting liquid droplets of a radiation curable ink composition onto a recording medium from an ejection head capable of ejecting the radiation curable ink composition using an ink jet recording device; and a second process for irradiating the liquid droplets with active radiation by an irradiation measure capable of emitting the active radiation, in which, among the liquid droplets of the radiation curable ink composition irradiated with the active radiation, a difference of the total irradiation energy of a liquid droplet having the highest total irradiation energy of the active radiation and a liquid droplet having the lowest total irradiation energy of the active radiation in the second process is 30% or more and 50% or lower of the irradiation energy ($E_{90}$) [mJ/cm$^2$] required for curing 90% of the radiation curable ink composition.

10 Claims, 2 Drawing Sheets

IMAGE FORMING METHOD AND INK JET RECORDING DEVICE

BACKGROUND

1. Technical Field

The present invention relates to an image forming method and an ink jet recording device.

2. Related Art

In recent years, the development of a radiation curable ink that is cured by ultraviolet rays, electron beams, and other radiation has been advanced. One of the reasons for using such a radiation curable ink resides in that fact that the ink exhibits quick drying properties in recording on a non-ink absorbing medium that does not absorb ink or hardly absorbs ink, such as plastics, glass, and coat paper. The radiation curable ink contains, for example, a polymerizable monomer, a polymerization initiator, a pigment, other additives, etc.

It is known to form an image on a recording medium using such a radiation curable ink by ejecting liquid droplets of the radiation curable ink onto a recording medium by an ink jet recording device, and then irradiating the ink with active radiation to thereby cure the ink.

The image formed using the radiation curable ink as described above is known to cause bleeding or cause a reduction in glossiness and color density depending on the ejection timing of the radiation curable ink, the irradiation conditions of radiations, and the like.

For example, JP-A-2003-211651 discloses that the glossiness or the like of an image formed on a recording medium changes depending on the ejection timing of the radiation curable ink or the irradiation energy. Japanese Patent No. 4147943 discloses that a high resolution image in which mixing of different colors hardly occurs is obtained by controlling the curing rate of an optical curable ink. JP-A-2007-276248 discloses, when ejecting different colors of radiation curable inks, controlling the irradiation timing of active radiation for each color in order to suppress mixing of different colors of the inks.

However, in the image formed by the image forming, method described above, the glossiness has not been sufficient, bleeding has occurred, and the color density has been low in some cases.

SUMMARY

An advantage of some aspects of the invention is to provide an image forming method capable of obtaining an image formed on a recording medium, the image in which the image glossiness is excellent, image bleeding is suppressed, and the color density is high.

The invention has been made in order to solve at least one part of the above-described object and can be realized as the following embodiments or Examples.

EXAMPLE 1

An image forming method according to an aspect of the invention, includes a first process for ejecting liquid droplets of a radiation curable ink composition onto a recording medium from an ejection head capable of ejecting the radiation curable ink composition using an ink jet recording device; and a second process for irradiating the liquid droplets with active radiation by an irradiation measure capable of emitting the active radiation, in which among the liquid droplets of the radiation curable ink composition irradiated with the active radiation, a difference of the total irradiation energy of a liquid droplet having the highest total irradiation energy of the active radiation and a liquid droplet having the lowest total irradiation energy of the active radiation in the second process is 30% or more and 50% or lower of the irradiation energy ($E_{90}$) [mJ/cm$^2$] required for curing 90% of the radiation curable ink composition.

According to the image forming method of Example 1, an image formed on the recording medium is obtained in which the glossiness is excellent, image bleeding can be reduced, and the color density is high.

EXAMPLE 2

An image forming method according to another aspect of the invention, includes a first process for ejecting liquid droplets of two or more kinds of radiation curable ink compositions onto a recording medium from an ejection head capable of ejecting the radiation curable ink compositions using an ink jet recording device; and a second process for irradiating the liquid droplets with active radiation by an irradiation measure capable of emitting the active radiation, in which in the two or more kinds of radiation curable ink compositions, a difference of the total irradiation energy of a liquid droplet having the highest total irradiation energy of the active radiation and a liquid droplet having the lowest total irradiation energy of the active radiation among liquid droplets of the same kind of the radiation curable ink compositions irradiated with the active radiation in the second process is 30% or more and 50% or lower of the irradiation energy ($E_{90}$) [mJ/cm$^2$] required for curing 90% of the radiation curable ink compositions.

According to the image forming method of Example 2, even when the two or more kinds of radiation curable ink compositions are ejected onto a recording medium, an image formed on the recording medium is obtained in which the glossiness is excellent, image bleeding can be reduced, and the color density is high.

EXAMPLE 3

In Example 1 or 2, the first process and the second process are performed while the ejection head is moving along a given direction; and the irradiation measure can be provided on at least one side in the given direction of the ejection head.

According to the image forming method of Example 3, the liquid droplet can be irradiated with active radiation with the movement of the ejection head.

EXAMPLE 4

According to any one of Examples 1 to 3, among the liquid droplets of the radiation curable ink composition irradiated with the active radiation, the number of times of the irradiation of the active radiation by the irradiation measure can be the highest in the liquid droplet having the highest total irradiation energy of the active radiation; and the number of times of the irradiation of the active radiation by the irradiation measure can be the lowest in the liquid droplet having the lowest total irradiation energy of the active radiation.

According to the image forming method of Example 4, when the liquid droplet having the highest number of times of the irradiation of the active radiation by the irradiation measure and the liquid droplet having the lowest number of times of the irradiation of the active radiation by the irradiation measure are present, an image formed on the recording medium is obtained in which the glossiness is excellent, image bleeding can be reduced, and the color density is high.

EXAMPLE 5

In any one of Examples 1 to 4, the $E_{90}$ can satisfy Equation (1) in the formation of an image by n times of main scanning when the irradiation energy per irradiation carried out by the irradiation measure is defined as E.

$$4(n-1)E \leq E_{90} \leq 20(n-1)E/3 \quad (1)$$

(In Equation (1), $n$ represents an integer of 2 or more.)

According to the image forming method of Example 5, the use of Equation (1) facilitates the preparation of the formulation of the radiation curable ink composition or the selection of the radiation curable ink composition.

EXAMPLE 6

In any one of Examples 1 to 5, the $E_{90}$ can be 180 [mJ/cm$^2$] or more and 250 [mJ/cm$^2$] or lower.

According to the image forming method of Example 6, the preparation of the formulation of the radiation curable ink composition or the selection of the radiation curable ink composition is further facilitated.

EXAMPLE 7

In Example 2, with respect to the $E_{90}$, a difference of $E_{90}$ ($\Delta E_{90}$) between the two or more kinds of radiation curable ink compositions can satisfy Equation (2) in the image formation by n times of main scanning when the irradiation energy per irradiation carried out by the irradiation measure is defined as E.

$$0 \leq \Delta E_{90} \leq 8(n-1)E/3 \quad (2)$$

(In Equation (2), $n$ represents an integer of 2 or more.)

According to the image forming method of Example 7, even when the liquid droplets of the two or more kinds of radiation curable ink compositions are ejected onto the recording medium, the use of Equation (2) allows easy setting of the irradiation conditions of the active radiation suitable for all the liquid droplets and obtaining a favorable image.

EXAMPLE 8

In Example 2 or 7, the difference of $E_{90}$ [mJ/cm$^2$] ($\Delta E_{90}$) between the two or more kinds of radiation curable ink compositions can be within 70 [mJ/cm$^2$].

According to the image forming method of Example 8, even when the liquid droplets of the two or more kinds of radiation curable ink compositions are ejected onto the recording medium, the irradiation conditions of the active radiation suitable for all the liquid droplets can be easily set and a favorable image can be obtained.

EXAMPLE 9

In any one of Examples 1 to 8, in the second process, the total irradiation energy emitted to the liquid droplet having the highest total irradiation energy of the active radiation and the total irradiation energy emitted to the liquid droplet having the lowest total irradiation energy of the active radiation each can be lower than $E_{90}$.

EXAMPLE 10

An ink jet recording device according to another aspect of the invention, has; an ejection head that ejects liquid droplets of a radiation curable ink composition onto a recording medium; and an active radiation irradiation device that irradiates the liquid droplets with active radiation, in which the ink jet recording device has a control measure for controlling a difference of the total irradiation energy of a liquid droplet having the highest total irradiation energy of the active radiation and a liquid droplet having the lowest total irradiation energy of the active radiation among the liquid droplets of the radiation curable ink composition irradiated with the active radiation to 30% or more and 50% or lower of the irradiation energy ($E_{90}$) [mJ/cm$^2$] required for curing 90% of the radiation curable ink composition.

According to the ink jet recording device of Example 10, an image can be recorded in which the glossiness is excellent, image bleeding can be suppressed, and the color density is high.

EXAMPLE 11

An image forming method according to another aspect of the invention, includes; in an image forming method using an ink jet recording device, an ejection process for ejecting liquid droplets of a radiation curable ink composition onto a recording medium from an ejection head capable of ejecting the radiation curable ink composition while performing main scanning in which the ejection head moves along a given direction; a first irradiation process for irradiating the liquid droplets on the recording medium with active radiation from first irradiation measures capable of emitting the active radiation that are provided at both ends in a given direction of the ejection head and move with the ejection head; and a second irradiation process for irradiating the liquid droplets on the recording medium transported in a sub-scanning direction with active radiation from a second irradiation measure capable of emitting the active radiation that is provided in the sub-scanning direction in which the recording medium is transported, in which the ejection process and the first irradiation process are repeated two or more times, and a difference of the total irradiation energy of a liquid droplet having the highest total irradiation energy of the active radiation emitted in the first irradiation process and a liquid droplet having the lowest total irradiation energy of the active radiation emitted in the first irradiation process is 30% or more and 50% or lower of the irradiation energy ($E_{90}$) [mJ/cm$^2$] required for curing 90% of the radiation curable ink composition.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments suitable for the invention will be described. The embodiments described below describe one example of the invention. The invention is not limited to the following embodiments and includes various modifications carried out in the range where the gist of the invention does not change.

1. First Embodiment 1.1. Image Forming Method

An image forming method according to an embodiment of the invention includes: a first process for ejecting liquid droplets of a radiation curable ink composition onto a recording medium from an ejection head capable of ejecting the radiation curable ink composition using an ink jet recording device; and a second process for irradiating the liquid droplets with active radiation by an irradiation measure capable of emitting the active radiation, in which, among the liquid droplets of the radiation curable ink composition irradiated with the active radiation, a difference of the total irradiation energy of a liquid droplet having the highest total irradiation energy of the active radiation and a liquid droplet having the lowest total irradiation energy of the active radiation in the second process is 30% or more and 50% or lower of the irradiation energy ($E_{90}$) [mJ/cm$^2$] required for curing 90% of the radiation curable ink composition. In the invention, the "image" refers to a print pattern formed from a dot group and also includes text printing and solid printing. The image forming method according to this embodiment is applied to the case of forming an image only using radiation curable ink compositions of the same formulation.

Hereinafter, the image forming method according to this embodiment will be described.

1.1.1. First Process

The first process is a process for ejecting liquid droplets of a radiation curable ink composition onto a recording medium from an ejection head capable of ejecting the radiation curable ink composition using an ink jet recording device.

Figure 1:
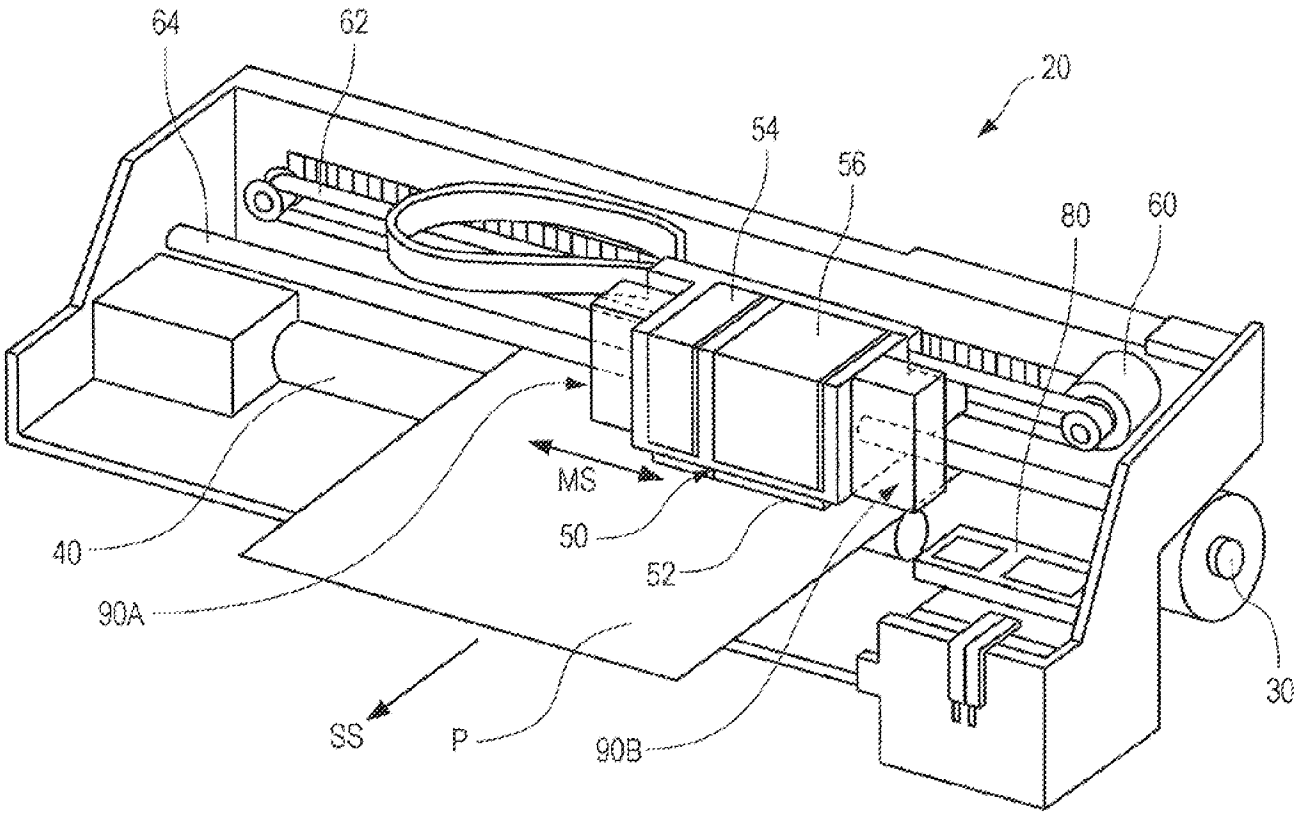
FIG. 1 is a perspective view of an ink jet recording device usable in an image forming method according to this embodiment.

As the ink jet recording device for use in the image forming method according to this embodiment, an ink jet recording device illustrated in FIG. 1 can be used, for example. FIG. 1 is a perspective view of the ink jet recording device usable in the image forming method according to this embodiment.

An ink jet recording device 20 illustrated in FIG. 1 has a motor 30 that transports a recording medium P in a sub-scanning direction SS, a platen 40, an ejection head 52 that forms a radiation curable ink composition into liquid droplets having a very small particle size, and jetting the liquid droplets from a head nozzle so that the liquid droplets are ejected onto the recording medium P, a carriage 50 on which the ejection head 52 is mounted, a carriage motor 60 that moves the carriage 50 in a main scanning direction MS, and a pair of active radiation irradiation devices 90A and 90B that irradiate, with active radiation, the liquid droplets that are attached onto the recording medium P by ejecting the liquid droplets of the radiation curable ink composition from the ejection head 52.

The carriage 50 is towed by a traction belt 62 that is driven by the carriage motor 60 to move along with a guide rail 64.

The ejection head 52 is mounted on the carriage 50 and performs main scanning in which the ejection head moves in the main scanning direction MS with the operation of the carriage 50 in the moving direction (hereinafter also referred to as a "main scanning direction") MS.

The ejection head 52 can eject the radiation curable ink composition. In the example of FIG. 1, the ejection head 52 is a serial type head for full color printing that jets 4 color inks, in which a large number of head nozzles are provided for each color. On the carriage 50 on which the ejection head 52 is to be mounted, a black cartridge 54 as a black ink container containing a black ink to be supplied to the ejection head 52 and a color ink cartridge 56 as a color ink containing a color ink to be supplied to the ejection head 52 are mounted in addition to the ejection head 52. The ink contained in each of the cartridges 54 and 56 is the radiation curable ink composition described later.

The amount of the liquid droplets ejected from the ejection head 52 in the first process of this embodiment is preferably 1 pl or more and 20 pl or lower. When the liquid droplet amount is within the range mentioned above, the ejection stability is favorable and a high-resolution image can be obtained.

A capping device 80 for sealing the nozzle surface of the ejection head 52 during stopping is provided at the home position (position at the right side of FIG. 1) of the carriage 50. When a print job is completed and the carriage 50 reaches the position above the capping device 80, the capping device 80 automatically rises with a mechanism, which is not illustrated, to seal the nozzle surface of the ejection head 52. The capping prevents drying of the inks in the nozzles. The positioning control of the carriage 50 is performed for, for example, accurately positioning the carriage 50 at the position of the capping device 80.

The use of such an ink jet recording device 20 allows ejection of the liquid droplets of the radiation curable ink composition on a recording medium. According to the ink jet recording device 20, the first process and the second process described later can be continuously performed with one device without performing the first process and the second process described later with separate devices.

1.1.2. Second Process

The second process is a process for irradiating the liquid droplets with the active radiation by an irradiation measure capable of emitting the active radiation. Hereinafter, the case where active radiation is emitted using the above-described ink jet recording device 20 will be described.

Figure 2:
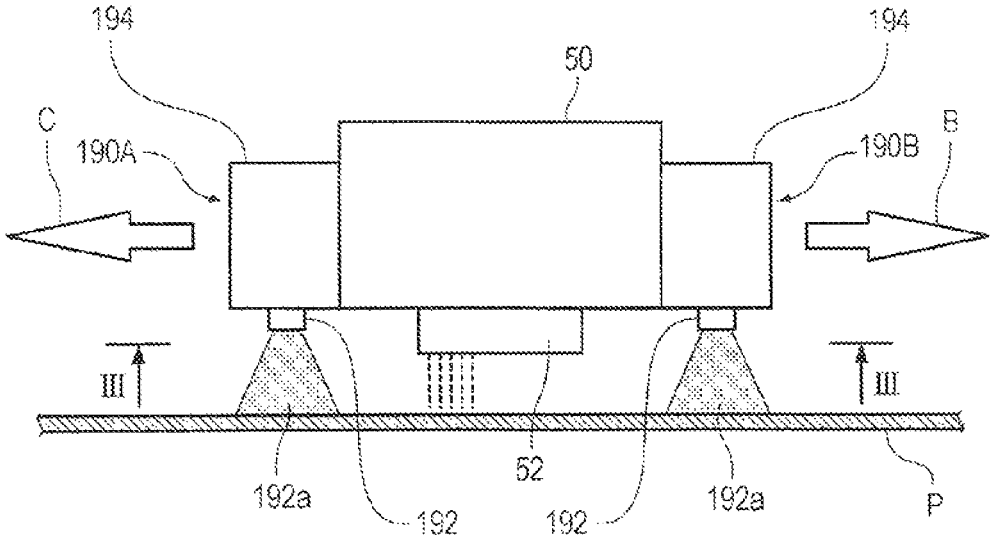
FIG. 2 is a front view of an active radiation irradiation device illustrated in FIG. 1.
Figure 3:
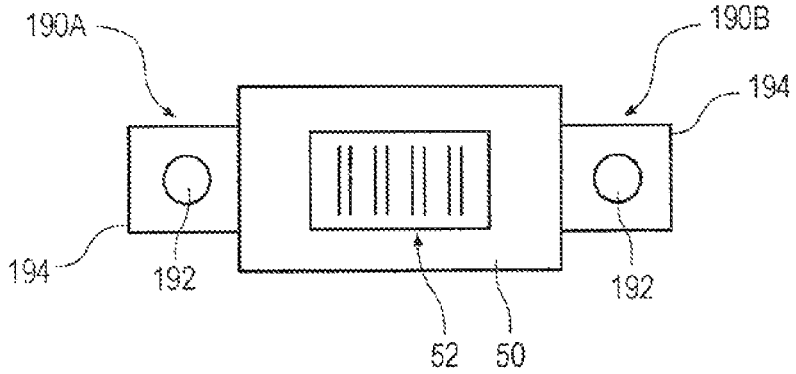
FIG. 3 is an arrow view along the III-III line of FIG. 2.

As the irradiation measure capable of emitting active radiation, active radiation irradiation devices illustrated in, for example, FIG. 1 and FIG. 2 are mentioned. FIG. 2 is a front view of the active radiation irradiation devices 90A (equivalent to 190A of FIG. 2) and 90B (equivalent to 190B of FIG. 2) illustrated in FIG. 1. FIG. 3 is an arrow view along the line of FIG. 2.

As illustrated in FIGS. 1 to 3, the active radiation irradiation devices 190A and 190B are individually attached to both side ends along the moving direction of the carriage 50.

As illustrated in FIG. 2, the active radiation irradiation device 190A attached to the left hand side of the ejection head 52 irradiates the liquid droplets ejected onto the recording medium P with active radiation during right scanning in which the carriage 50 moves in the right direction (direction of arrow B of FIG. 2). In contrast, the active radiation irradiation device 190B attached to the right hand side of the ejection head 52 irradiates the liquid droplets ejected onto the recording medium P with active radiation during left scanning in which the carriage 50 moves in the left direction (direction of arrow C of FIG. 2).

Each of the active radiation irradiation devices 190A and 190B is attached to the carriage 50 and has a case 194 supporting one active radiation light source 192 in alignment therewith and a light source control circuit (not illustrated) that controls light on and out of the active radiation light source 192. The active radiation irradiation devices 190A and 190B each are provided with one active radiation light source 192 as illustrated in FIGS. 2 and 3 but may be provided with two or more active radiation light sources 192. As the active radiation light source 192, either an LED (Light Emitting Diode) or an LD (Laser Diode) is preferably used. Thus, as compared with the case where a mercury lamp, a metal halide lamp, and other lamps are used as the active radiation light source, an increase in the size of the active radiation light source due to the equipment of a filter and the like can be avoided. Moreover, the intensity of the active radiation emitted by the absorption with a filter does not decrease, and thus the radiation curable ink composition can be efficiently secured.

In each active radiation light source 192, the wavelength to be emitted may be the same or different. When an LED or an LD is used as the active radiation light source 192, the wavelength of the active radiation to be emitted may be in the range of about 350 nm to about 430 nm.

According to the active radiation irradiation devices 190A and 190B, as illustrated in FIG. 2, active radiation 192*a* is emitted to the liquid droplets, which are attached onto the recording medium P by the ejection from the ejection head 52, by the active radiation light source 192 irradiating the surface of the recording medium P near the ejection head 52 to cure at least the surface of the liquid droplets, and thus an image can be formed on the recording medium.

In the image forming method of this embodiment, the image can be formed so that the film thickness of the image formed on the recording medium is 1 μm or more and 30 μm or lower. When the film thickness of the image formed on the recording medium is within the range mentioned above, curling of the recording medium, wrinkles of the image, and the like can be reduced, and thus a favorable image can be obtained.

Hereinafter, a method for forming an image in a desired region by repeating the first process and the second process in this embodiment two or more times will be described in detail.

First, first liquid droplets are ejected onto the recording medium P while moving the carriage 50 in the right direction (direction of arrow B of FIG. 2), and then the first liquid droplets are irradiated with active radiation by the active radiation irradiation device 190A. Subsequently, sub-scanning in which the recording medium P is moved in the sub-scanning direction SS is performed. The movement distance of the recording medium P in the sub-scanning is shorter than the distance in the sub-scanning direction of nozzle rows for use in recording of the ejection head 52. The sub-scanning direction SS in this embodiment is orthogonal to the main scanning direction MS but is not limited thereto and is determined based on a direction in which the recording medium P is transported.

In this description, one main scanning in which liquid droplets are ejected while moving the carriage 50 in one direction of the main scanning direction MS, and then the liquid droplets are irradiated with active radiation is referred to as 1 pass.

Thereafter, one main scanning (1 pass) in which second liquid droplets are ejected onto the recording medium P by the method described in the first process while moving the carriage 50 in the left direction (direction of arrow C of FIG. 2), and then the second liquid droplets are irradiated with active radiation by the active radiation irradiation device 190B is further performed. In the operation, the first liquid droplets on the recording medium are irradiated with active radiation by the active radiation irradiation device 190A and the active radiation irradiation device 190B. Next, sub-scanning in which the recording medium P is moved in the sub-scanning direction SS is further performed.

By the operation described above, the first liquid droplets are irradiated with active radiation by two passes and are irradiated with active radiation 3 times in total, i.e., once in the first pass and twice in the second pass. The second liquid droplets are irradiated with active radiation by 1 pass and one active radiation irradiation is performed.

By further repeatedly performing such operation, an image containing a group of liquid droplets can be formed in a given region (region having a width corresponding to the distance of the nozzle rows of the ejection head 52 in the sub-scanning direction and extending in the main scanning direction) of the recording medium. By n-time passes by the repetition of the pass and the sub-scanning, the positional relationship in which the positions in the sub-scanning direction of the nozzle rows of the ejection head 52 and the first liquid droplets on the recording medium do not overlap is established, and thus the image formation on a given region is completed. Before the completion of the image formation, the first liquid droplets ejected in the first pass are irradiated by n-time passes. During the operation, the n-th liquid droplet ejected by the n-th pass is irradiated by 1 pass. Among the liquid droplets forming the image, the liquid droplets ejected by a nozzle positioned at the uppermost stream in the sub-scanning direction among the nozzle rows for use in recording of the ejection head 52 are the first liquid droplets and the liquid droplets ejected by a nozzle positioned at the lowest stream in the sub-scanning direction among the nozzle rows for use in recording of the ejection head 52 are the n-th liquid droplets.

The first liquid droplets are liquid droplets in which the number of passes, in which the liquid droplets are irradiated in the image formation, is the largest and are liquid droplets in which the number of times of irradiation is the largest among the liquid droplets forming the image. In contrast, the n-th liquid droplets are liquid droplets in which the number of passes, in which the liquid droplets are irradiated in the image formation, is the smallest and are liquid droplets in which the number of times of irradiation is the smallest.

Each liquid droplet is cured to a degree such that dot bleeding or the occurrence of mixing of colors can be suppressed by the irradiation performed in the image formation. In this description, the state where the liquid droplets are cured to such a state is referred to as "semi-cured". More specifically, when the image formation is completed, the respective liquid droplets forming the image are at least semi-cured. The semi-curing is achieved by irradiating the liquid droplets of the radiation curable ink composition with active radiation until the curing rate of the liquid droplets is lower than 90%. The total irradiation energy applied to the semi-cured liquid droplets is lower than the irradiation energy ($E_{90}$) [mJ/cm$^2$] required for curing 90% of the radiation curable ink composition described later.

Each liquid droplet is semi-cured by irradiation in the image formation. Thereafter, the recording medium on which the image is formed can be irradiated for further curing each liquid droplet. In this description, the state where the liquid droplets are cured to such a state is referred to as "completely cured". The completely curing is achieved by irradiating the liquid droplets of the radiation curable ink composition with active radiation in such a manner that the curing rate of the liquid droplets is 90% or more. During the operation, the total irradiation energy applied to the liquid droplets before completely curing is equal to or higher than the irradiation energy ($E_{90}$) [mJ/cm$^2$] required for curing 90% of the radiation curable ink composition described later. By the completely curing, the liquid droplets can be cured to the degree of having no problems in practical use.

The ink jet recording device 20 for use in the image forming method of this embodiment may separately have an active radiation irradiation measure (not illustrated) for completely curing at the downstream side in the sub-scanning direction SS which is the moving direction of the recording medium P.

Thus, by emitting radiation to the liquid droplets from the active radiation irradiation measure for completely curing after the completion of the image formation on a recording medium through all the passes, the liquid droplets on the recording medium P can be completely cured.

The active radiation irradiation measure for completely curing provided at the downstream side of the sub-scanning direction SS may be provided at the position where active radiation can be emitted to the liquid droplets on the recording medium P transported in the sub-scanning direction SS and, for example, can be provided at the carriage 50 and at the downstream side (the sub-scanning direction SS which is the moving direction of the recording medium P) of the ejection head 52. Or, the active radiation irradiation measure for completely curing may not be provided at the carriage 50 and may be provided at the downstream side of the sub-scanning direction SS in the carriage. As the active radiation irradiation measure for completely curing, the same device as the active radiation irradiation device 190A (190B) can be used.

The completely curing is not limited to being carried out by the active radiation irradiation measure for completely curing provided at the downstream side of the sub-scanning direction SS and can be carried out by the active radiation irradiation device 190A and the active radiation irradiation device 190B.

1.1.3. Active Radiation Irradiation Conditions

The active radiation irradiation conditions in the image forming method of this embodiment will be described below in detail.

According to the image forming method of this embodiment, a difference of the total irradiation energy of a liquid droplet having the highest total irradiation energy of the active radiation and a liquid droplet having the lowest total irradiation energy of the active radiation among the liquid droplets of the radiation curable composition irradiated with active radiation is 30% or more and 50% or lower of the irradiation energy ($E_{90}$) [mJ/cm$^2$] required for curing 90% of the radiation curable ink composition.

Even in the case of liquid droplets of the same type of radiation curable ink compositions, the total irradiation energy emitted to the liquid droplets varies for each liquid droplet depending on the number of passes, irradiation conditions, ejection timing of the liquid droplets, liquid droplet impact portions, etc. For example, in the method for forming an image in a given region of "1.1.2. Second Process", when the image formation (printing) is completed by two passes, the first liquid droplets are irradiated with active radiation 3 times and the second liquid droplets are irradiated with active radiation once. Therefore, when the irradiation intensity of the active radiation irradiation devices 190A and 1908 is fixed, the total irradiation energy emitted to the first liquid droplets becomes higher than the total irradiation energy emitted to the second liquid droplets. Thus, when the total irradiation energy varies for each liquid droplet, image bleeding occurs or the glossiness or the color density of the image decreases in some cases.

Therefore, by adjusting a difference of the total irradiation energy of a liquid droplet having the highest total irradiation energy of the active radiation and a liquid droplet having the lowest total irradiation energy of the active radiation among the liquid droplets of the radiation curable ink composition irradiated with the active radiation to fall in the range of 30% or more and 50% or lower of the irradiation energy ($E_{90}$) [mJ/cm$^2$] required for curing 90% of the radiation curable ink composition, an image can be formed in which image bleeding can be reduced, the image glossiness is excellent, and the color density is high.

In contrast, when the difference of the total irradiation energy is lower than 30% of $E_{90}$, the curing of some of the ejected liquid droplets becomes insufficient, and thus the insufficiently cured liquid droplets wet and spread to the impact portions of the other liquid droplets, which sometimes results in the fact that image bleeding occurs or the color density of the image decreases.

When the difference of the total irradiation energy exceeds 50% of $E_{90}$, the liquid droplets do not sufficiently wet and spread due to rapid curing of some liquid droplets, which sometimes results in a reduction in the glossiness of the image or a reduction in the color density of the image.

The irradiation energy ($E_{90}$) [mJ/cm$^2$] required for curing 90% of the radiation curable ink composition in the invention refers to irradiation energy of active radiation required for achieving an inversion rate of 90% of a polymerizable compound in the radiation curable ink composition. When the inversion rate of the polymerizable compound contained in the radiation curable ink composition becomes 90% or more, the radiation curable ink composition is sufficiently cured, and thus a favorable image having no problems in practical use can be obtained on a recording medium. The inversion rate can be determined from the change value of the absorbance at the peak of a specific absorption spectrum using an FT-IR (Fourier Transform-InfraRed spectroscopy).

The image forming method in this embodiment is excellent in that when the irradiation intensity of active radiation is set in such a manner that the difference of the total irradiation energy between liquid droplets falls in the range mentioned above in the ink jet recording device in which a required number of passes for forming a given image is set, a favorable image is easily obtained.

The image forming method in this embodiment is also excellent in that when the number of passes is set in such a manner that the difference of the total irradiation energy between liquid droplets falls in the range mentioned above in the ink jet recording device in which the irradiation intensity of active radiation in the active radiation irradiation device is determined, a favorable image is easily obtained.

The total irradiation energy emitted to the liquid droplets ejected onto the recording medium can be determined as follows when the ejection head 52 can move back and forth in the main scanning direction MS and the irradiation measures are provided on both sides of the ejection head 52 along the moving direction of the ejection head 52 as illustrated in FIGS. 1 to 3.

For example, in forming an image by n-time passes (n is an integer of 2 or more), the number of times of irradiation of the active radiation to each of a liquid droplet having the highest total irradiation energy of the active radiation (hereinafter also referred to as "Li") and a liquid droplet having the lowest total irradiation energy of the active radiation (hereinafter also referred to as "Lf") is as follows.

Since the irradiation measures are provided on both sides of the ejection head 52, the number of times of irradiation of the active radiation emitted to the Li is (2n−1) times in the case of n-time passes. The number of times of irradiation of the active radiation emitted to the Lf is once because the active radiation is emitted from only one of the irradiation measures. The number of times of passes n is the number of times of passes in which each liquid droplet on the recording medium is irradiated with the active radiation, and thus there may be present n kinds of liquid droplets of from 1 to n in which the number of times of irradiation is different.

Considering the above, when the irradiation energy per irradiation carried out by the irradiation measures is defined as E [mJ/cm$^2$], the total irradiation energy emitted to the Li (hereinafter also referred to as "Ei") is represented by Equation (A). The total irradiation energy emitted to the Lf (hereinafter also referred to as "Ef") is represented by Equation (B).

$$Ei=E\times(2n-1) \quad (A)$$

$$Ef=E \quad (B)$$

Ei [mJ/cm$^2$] and Ef [mJ/cm$^2$] satisfy Equation (C).

$$0.3\leq(Ei-Ef)/E_{90}\leq0.5 \quad (C)$$

From Equations (A) to (C) above, the range of values which $E_{90}$ can take can be represented by Equation (1).

$$4(n-1)E\leq E_{90}\leq20(n-1)E/3 \text{ (}n\text{ represents an integer of 2 or more.)} \quad (1)$$

In the ink jet recording device for use in the image forming method of this embodiment, when the irradiation energy per irradiation carried out by the irradiation measures E [mJ/cm$^2$] and the number of passes n for forming a given image are determined, the use of Equation (1) facilitates preparation of the formulation of the radiation curable ink composition or selection of the radiation curable ink composition.

($E_{90}$) [mJ/cm$^2$] of the two or more kinds of radiation curable ink compositions for use in the image forming method of this embodiment varies depending on the formulation of the radiation curable ink compositions and is not particularly limited and is more preferably 180 [mJ/cm$^2$] or more and 250 [mJ/cm$^2$] or lower, for example.

1.2. Radiation Curable Ink Composition

Next, the radiation curable ink composition for use in the image forming method according to this embodiment will be described in detail.

1.2.1. Polymerizable Compound

The radiation curable ink composition according to this embodiment contains a polymerizable compound. Examples of the polymerizable compound include the following monofunctional monomers, bifunctional monomers, trifunctional monomers, urethane acrylate oligomers, and amino acrylate.

The monofunctional monomers are not particularly limited and examples include (2-methyl-2-ethyl-1,3-dioxolane-4-yl) methyl(meth)acrylate, (2-methyl 2-isobutyl-1,3-dioxolane-4-yl)methyl(meth)acrylate, phenoxyethyl(meth)acrylate, isobornyl(meth)acrylate, methoxy diethylene glycol mono (meth)acrylate, (meth)acryloyl morpholine, dicyclopentenyloxyethyl(meth)acrylate, dicyclo pentenyl(meth)acrylate, dicyclopentanyl(meth)acrylate, isobornyl(meth)acrylate, trimethylolpropane formal mono(meth)acrylate, adamantyl (meth)acrylate, oxetane(meth)acrylate, and 3,3,5-trimethylcyclohexane(meth)acrylate. These polymerizable compounds can also be used singly or in combination of two or more kinds thereof. In this description, the "(meth)acrylate" represents acrylate or methacrylate.

The bifunctional monomers are not particularly limited and examples include alkylene glycol di(meth)acrylate and di(meth)acrylate having an alicyclic structure. Examples of the alkylene glycol di(meth)acrylate include ethylene glycol di(meth)acrylate, diethylene glycol di(meth)acrylate, dipropyrene glycol di(meth)acrylate, tripropylene glycol di(meth) acrylate, 1,9-nonanediol di(meth)acrylate, polyethylene glycol di(meth)acrylate, tetraethylene glycol di(meth)acrylate, 1,6-hexanediol di(meth)acrylate, neopentyl glycol di(meth) acrylate, and 2-hydroxy-1,3-di(meth)acryloxypropane. Examples of the di(meth)acrylate having an alicyclic structure include tricyclodecane dimethanol di(meth)acrylate, dioxane glycol di(meth)acrylate, isocyanuric acid EO-modified di(meth)acrylate, dimethylol tricyclodecane di(meth) acrylate, and 1,3-adamantanediol di(meth)acrylate. These polymerizable compounds can also be used singly or in combination of two or more kinds thereof.

The trifunctional monomers are not particularly limited and examples include trimethylol propane tri(meth)acrylate, trimethylolpropane EO-modified tri(meth)acrylate, trimethylolpropane PO-modified tri(meth)acrylate, glycerin PO-modified tri(meth)acrylate, and isocyanuric acid EO-modified tri(meth)acrylate.

As other polymerizable compounds, N-vinyl compounds may be contained. Examples of the N-vinyl compounds include N-vinyl formamide, N-vinyl carbazole, N-vinyl acetamide, N-vinyl pyrrolidone, N-vinyl caprolactam, and derivatives thereof.

As the polymerizable compound, a urethane oligomer may be contained. The urethane oligomer refers to one having a urethane bond and one or more radically polymerizable unsaturated double bonds in the molecules. Here, the oligomer for use in this embodiment refers to molecules of intermediate relative molecular mass (synonymous with a molecular weight) having a repetition structure of a small plurality, generally about twice to about 20 times, of units substantially or conceptually derived from molecules of low relative molecular mass.

Examples of the urethane oligomer include oligomers produced by the addition reaction of polyol and polyisocyanate and a polyhydroxy compound. Examples of the urethane oligomer include polyester urethane acrylate, polyether urethane acrylate, polybutadiene urethane acrylate, and polyol urethane acrylate. Specific examples of the urethane oligomer include CN963J75, CN964, CN965, and CN966J75 (all are available from SARTOMER).

As the polymerizable compound, aminoacrylate may be contained. Examples of the aminoacrylate include one obtained by reacting bifunctional (meth)acrylate and an amine compound.

Examples of the bifunctional acrylate include alkylene glycol di(meth)acrylates, such as propylene glycol di(meth) acrylate, 1,3-butylene glycol di(meth)acrylate, 1,4-butanediol di(meth)acrylate, 1,6-hexanediol di(meth)acrylate, 1,9-nonanediol di(meth)acrylate, and neopentyl glycol di(meth) acrylate, bisphenol alkylene oxide adduct di(meth)acrylates, such as di(meth)acrylate of an ethylene oxide adduct of bisphenol S, di(meth)acrylate of an ethylene oxide adduct of bisphenol F, di(meth)acrylate of an ethylene oxide adduct of bisphenol A, di(meth)acrylate of an ethylene oxide adduct of thiobisphenol, and di(meth)acrylate of an ethylene oxide adduct of brominated bisphenol A, polyalkylene glycol di(meth)acrylates, such as polyethylene glycol di(meth)acrylate and polypropylene glycol di(meth)acrylate, and di(meth) acrylate of neopentyl glycol hydroxypivalate.

Examples of the amine compound include monofunctional amine compounds, such as ethylamine, n-propylamine, isopropylamine, n-butylamine, isobutylamine, n-pentylamine, isopentylamine, n-hexylamine, cyclohexylamine, n-heptylamine, n-octylamine, 2-ethylhexyl amine, n-nonylamine, n-decylamine, n-dodecylamine, n-tetradecylamine, n-hexadecylamine, n-octadecylamine, benzylamine, and phenethylamine and polyfunctional amine compounds, such as diethylenetriamine, triethylenetetramine, tetraethylenepentamine, 1,6-hexamethylenediamine, 1,8-octamethylenediamine, 1,12-dodecamethylenediamine, o-phenylenediamine, p-phenylenediamine, m-phenylenediamine, o-xylylenediamine, p-xylylenediamine, m-xylylenediamine, menthanediamine, bis(4-amino-3-methylcyclohexyl)methane, 1,3-diaminocyclohexane, isophoronediamine, and spiroacetal diamine. In addition, high molecular weight polyfunctional amine compounds, such as polyethyleneimine, polyvinylamine, and polyallylamine can also be mentioned.

The content of the polymerizable compound is preferably 20% by mass or more and more preferably 20% by mass or more and 95% by mass or lower based on the total mass of the radiation curable ink composition.

1.2.2. Photopolymerization Initiator

The radiation curable ink composition according to this embodiment may contain a photopolymerization initiator. The photopolymerization initiator is a general term of compounds having a function of initiating a copolymerization reaction of the polymerizable compound described above by irradiating the radiation curable ink composition ejected onto the recording medium with active radiation.

Examples of the photopolymerization initiator include known photopolymerization initiators, such as an alkylphenone photopolymerization initiator, an acylphosphine oxide photopolymerization initiator, a titanocene photopolymerization initiator, and a thioxanthone photopolymerization initiator. Among the above, molecule cleavage types, such as 2,4,6-trimethylbenzoyl-diphenyl-phosphine oxide having excellent compatibility with the reaction components described above and bis(2,4,6-trimethylbenzoyl)-phenylphosphine oxide having broad light absorption properties or a hydrogen abstraction type, such as diethyl thioxanthone, are preferable. The reason for the fact that the acylphosphine oxide photopolymerization initiator is preferable resides in the fact that the absorption considerably changes because the structure of a chromophore considerably changes before and after photocleavage and a short wavelength of absorption referred to as photobleaching (photofading) is observed. Moreover, although the absorption reaches a UV region from a VL region, yellowing is hard to occur and internal curing is excellent. Therefore, the photopolymerization initiator is particularly preferable for a transparent thick film or a pigment containing coat film having high hiding power. The reason for the fact that the thioxanthone photopolymerization initiator is preferable resides in the fact that the thioxanthone photopolymerization initiator has an action of reacting with oxygen remaining in the reaction system after photocleavage to reduce the oxygen concentration in the system. The radical polymerization hindering degree can be reduced corresponding to the reduction in the oxygen concentration, and thus the surface curing properties can be improved. Furthermore, it is particularly preferable to use the acylphosphine photopolymerization initiator and the thioxanthone photopolymerization initiator in combination. These photopolymerization initiators can also be used singly, but when used in combination of two or more kinds thereof, the properties of each photopolymerization initiator can be maximized.

The content of the photopolymerization initiator is preferably 1% by mass or more and 20% by mass or lower and more preferably 5% by mass or more and 15% by mass or lower based on the total mass of the radiation curable ink composition.

1.2.3. Other Additives

The radiation curable ink composition according to this embodiment can contain additives, such as pigments, dispersants, slipping agents, photosensitizers, and polymerization inhibitors, as required.

The radiation curable ink composition according to this embodiment can function as a so-called clear ink as it is but pigments may be added thereto. Pigments usable in this embodiment are not particularly limited and inorganic pigments and organic pigments are mentioned. As the inorganic pigments, carbon black manufactured by known methods, such as a contact method, a furnace method, and a thermal method, can be used in addition to titanium oxide and iron oxide. In contrast, usable as the organic pigments are azo pigments (including azo lake, insoluble azo pigments, condensed azo pigments, and chelate azo pigments) and polycyclic pigments (e.g., a phthalocyanine pigment, a perylene pigment, a perynone pigment, an anthraquinone pigment, and a quinofuralone pigment), nitro pigments, nitroso pigments, and aniline black.

Among specific examples of pigments usable in this embodiment, C.I. pigment black 7 is mentioned as carbon black. Examples include No. 2300, No. 900, MCF88, No. 33, No. 40, No. 45, No. 52, MA7, MA8, MA100, No. 2200B, and the like available from Mitsubishi Chemical, Inc., Raven5750, Raven5250, Raven5000, Raven3500, Raven1255, Raven700, and the like available from Colombia Chemical Company, Regal400R, Regal330R, Regal660R, MogulL, Mogul700, Monarch800, Monarch880, Monarch900, Monarch1000, Monarch1100, Monarch1300, Monarch1400, and the like available from Cabot Corp., and ColorBlackFW1, ColorBlackFW2, ColorBlackFW2V, ColorBlackFW18, ColorBlackFW200, ColorBlackS150, ColorBlackS160, ColorBlackS170, Printex35, PrintexU, PrintexV, Printex140U, SpecialBlack6, SpecialBlack5, SpecialBlack4A, and SpecialBlack4, and the like available from Degussa.

Examples of pigments usable when forming the radiation curable ink composition according to this embodiment into a yellow ink include C.I. Pigment Yellow 1, 2, 3, 12, 13, 14, 16, 17, 73, 74, 75, 83, 93, 95, 97, 98, 109, 110, 114, 120, 128, 129, 138, 150, 151, 154, 155, 180 185, and 213.

Examples of pigments usable when forming the radiation curable ink composition according to this embodiment into a magenta ink include C.I. Pigment Red 5, 7, 12, 48(Ca), 48(Mn), 57(Ca), 57:1, 112, 122, 123, 168, 184, 202 and 209 and C.I. Pigment violet 19.

Examples of pigments usable when forming the radiation curable ink composition according to this embodiment into a cyan ink include C.I. Pigment Blue 1, 2, 3, 15:3, 15:4, 16, 22, and 60.

Examples of pigments usable when forming the radiation curable ink composition according to this embodiment into a green ink include C.I. Pigment green 7, 8, and 36.

Examples of pigments usable when forming the radiation curable ink composition according to this embodiment into an orange ink include C.I. Pigment orange 51 and 66.

Examples of pigments usable when forming the radiation curable ink composition according to this embodiment into a white ink include basic lead carbonate, zinc oxide, titanium oxide, and strontium titanate.

The average particle size of the pigments usable in this embodiment is preferably in the range of 10 nm or more and 200 nm or lower and more preferably in the range of 50 nm or more and 150 nm or lower.

The addition amount of the pigments that can be added to the radiation curable ink composition according to this embodiment is 0.1% by mass or more and 25% by mass or lower and more preferably 0.5% by mass or more and 15% by mass or lower based on the total mass of the radiation curable ink composition.

To the radiation curable ink composition according to this embodiment, dispersants may be added in order to increase the dispersibility of the pigments described above. Examples of the dispersants usable in this embodiment include high molecular weight dispersants, such as Solsperse3000, 5000, 9000, 12000, 13240, 17000, 24000, 26000, 28000, and 36000 (all manufactured by Lubrizol Corporation) and DISCOALL N-503, N-506, N-509, N-512, N-515, N-518, and N-520 (all manufactured by DAI-ICHI KOGYO SEIYAKU Co., Ltd.).

To the radiation curable ink composition according to this embodiment, slipping agents may be added. The slipping agent usable in this embodiment is preferably a silicone surfactant and more preferably polyester-modified silicone or polyether-modified silicone. Specifically, examples of the polyester-modified silicone include BYK-347, BYK-348, BYK-UV3500, BYK-UV3510, and BYK-UV3530 (all manufactured by BYK-Chemie Japan K.K.). Examples of the polyether-modified silicone include BYK-3570 (manufactured by BYK-Chemie Japan K.K.).

To the radiation curable ink composition according to this embodiment, a photosensitizer may be added. Examples of the photosensitizer usable in this embodiment include amine compounds (e.g., aliphatic amine, amine containing an aromatic group, piperidine, a reaction product of epoxy resin and amine, and triethanolamine triacrylate), urea compounds (e.g., allyl thiourea and o-tolylthiourea), sulfur compounds (e.g., sodium diethyl dithiophosphate and soluble salt of aromatic sulfinic acid), nitrile compounds (e.g., N,N-diethyl-p-aminobenzonitrile), phosphorus compounds (tri-n-butylphosphine and sodium diethyl dithiophosphide), nitrogen compounds (e.g., Michler's ketone, an N-nitrosohydroxylamine derivative, an oxazolidine compound, a tetrahydro-1,3-oxazine compound, and a condensate of formaldehyde or acetaldehyde and diamine), and chloride compounds (e.g., carbon tetrachloride and hexachloroethane).

To the radiation curable ink composition according to this embodiment, a polymerization inhibitor may be added. Examples of the polymerization inhibitor usable in this embodiment include hydroquinone, benzoquinone, and p-methoxyphenol.

1.2.4. Physical Properties (1) Viscosity

The viscosity at 20° C. of the radiation curable ink composition according to this embodiment is preferably 5 mPa·s or more and 50 mPa·s or lower and more preferably 20 mPa·s or more and 40 mPa·s or lower. When the viscosity at 20° C. of the radiation curable ink composition is within the range mentioned above, a proper amount of the radiation curable ink composition is ejected from a nozzle and curved flight or scattering of the radiation curable ink composition can be further reduced. Thus, the radiation curable ink composition can be preferably used for ink jet recording devices. The viscosity is measured as follows. The Shear Rate is increased to 10 to 1000 under a 20° C. environment, and then the viscosity at a Shear Rate of 200 is read using a viscoelasticity testing machine MCR-300 (manufactured by Pysica).

(2) Surface Tension

The surface tension at 20° C. of the radiation curable ink composition according to this embodiment is preferably 20 mN/m or more and 30 mN/m or lower. When the surface tension at 20° C. of the radiation curable ink composition is within the range mentioned above, the radiation curable ink composition is hard to wet to a nozzle subjected to liquid repellent treatment. Thus, a proper amount of the radiation curable ink composition is ejected from a nozzle and curved flight or scattering of the radiation curable ink composition can be further reduced. Therefore, the radiation curable ink composition can be preferably used in ink jet recording devices. The surface tension is measured by confirming the surface tension when a platinum plate is soaked in ink under a 20° C. environment using an automatic surface tension meter CBVP-Z (manufactured by Kyowa Interface Science Co., LTD.).

1.3. Recording Medium

A recording medium for use in the image forming method according to this embodiment is preferably a non-ink absorbing or low-ink absorbing recording medium. When the image forming method of this embodiment is used, a favorable image can be formed even when the recording medium is a non-ink absorbing or low-ink absorbing recording medium.

Examples of the non-ink absorbing recording medium include one in which plastics are coated on a base material, such as a plastic film or paper that has not been surface treated for ink jet printing (i.e., an ink absorption layer is not formed) and one in which a plastic film has been attached thereto. Examples of the plastics mentioned here include polyvinyl chloride, polyethylene terephthalate, polycarbonate, polystyrene, polyurethane, polyethylene, and polypropylene. Examples of the low-ink absorbing recording medium include printing paper, such as art paper, coat paper, and mat paper.

Here, the "non-ink absorbing or low-ink absorbing recording medium" in this description refers to a "recording medium in which the water absorption amount from the initiation of contact to 30 $msec^{1/2}$ is 10 $mL/m^2$ or lower in the Bristow method". This Bristow method is the most spread method as a method for measuring the liquid absorption amount in a short time and is employed also in the Japan Technical Association of the Pulp and Paper Industry (JAPAN TAPPI). The details of a test method are described in "Liquid Absorbency Test Method of Paper and Paperboard (Bristow Method) of No. 51 of "JAPAN TAPPI paper pulp test method, 2000". In this description, the non-ink absorbing or low-ink absorbing recording medium is also referred to as "plastic media".

2. Second Embodiment

An image forming method according to this embodiment of the invention includes: a first process for ejecting liquid droplets of two or more kinds of radiation curable ink compositions onto a recording medium from an ejection head capable of ejecting the radiation curable ink compositions using an ink jet recording device; and a second process for irradiating the liquid droplets with active radiation by an irradiation measure capable of ejecting the active radiation, in which, in the two or more kinds of radiation curable ink compositions, a difference of the total irradiation energy of a liquid droplet having the highest total irradiation energy of the active radiation and a liquid droplet having the lowest total irradiation energy of the active radiation among liquid droplets of the same kind of the radiation curable ink compositions irradiated with the active radiation in the second process is 30% or more and 50% or lower of the irradiation energy ($E_{90}$) [$mJ/cm^2$] required for curing 90% of the radiation curable ink compositions.

The image forming method according to the second embodiment is different from the image forming method according to the first embodiment in that the liquid droplets of two or more kinds of radiation curable ink compositions are ejected onto a recording medium. More specifically, the image forming method according to the second embodiment can be used for so-called color printing using two or more colors of radiation curable ink compositions.

Hereinafter, the image forming method in this embodiment will be described but the description of the same components and the same functions as those of the first embodiment will be omitted. The image formation of this embodiment can demonstrate the same effects as those of the above-described first embodiment and the description of the same effects will be omitted.

The ejection head in this embodiment ejects liquid droplets of two or more kinds of radiation curable ink compositions onto a recording medium. As the two or more kinds of radiation curable ink compositions, radiation curable ink compositions in which the contained materials are different for each radiation curable ink composition may be used or radiation curable ink compositions in which the contained materials are the same for each radiation curable ink composition and the formulation ratios are different may be used. Specifically, when color printing is performed, two or more colors of liquid droplets in which the hue is different from each other are ejected onto a recording medium.

The image forming method according to the second embodiment is excellent in that, in the ink jet recording device in which a required number of passes for forming a given image is set, when the irradiation intensity of the active radiation is set in such a manner that the irradiation energy between the same kind of liquid droplets fall in the range mentioned above, a favorable image is easily obtained even when the liquid droplets of the two or more kinds of radiation curable ink compositions are ejected onto a recording medium.

Furthermore, the image forming method according to the second embodiment is excellent in that, in the ink jet recording device in which the irradiation intensity of the active radiation in the active radiation irradiation devices is determined, when the number of passes is set in such a manner that a difference in the total irradiation energy between the same kind of liquid droplets falls in the range mentioned above, a favorable image is easily obtained even when the liquid droplets of the two or more kinds of radiation curable ink compositions are ejected onto a recording medium.

Similarly as in the first embodiment, ($E_{90}$) [mJ/cm$^2$] of the two or more kinds of radiation curable ink compositions for use in the image forming method of this embodiment can satisfy Equation (1).

$$4(n-1)E \leq E_{90} \leq 20(n-1)E/3 \quad (1)$$

(In Equation (1), $n$ represents an integer of 2 or more.)

In the ink jet recording device for use in the image forming method of this embodiment, when the irradiation energy per irradiation carried out by the irradiation measures E [mJ/cm$^2$] and the number of passes n for forming a given image are determined, the use of Equation (1) facilitates preparation of the formulation of the radiation curable ink composition or selection of the radiation curable ink composition.

($E_{90}$) [mJ/cm$^2$] of the two or more kinds of radiation curable ink compositions for use in the image forming method of this embodiment varies depending on the formulation of the radiation curable ink compositions and is not particularly limited and is more preferably 180 [mJ/cm$^2$] or more and 250 [mJ/cm$^2$] or lower, for example. When radiation curable ink compositions having $E_{90}$ in the range mentioned above are used, the irradiation conditions of the active radiation suitable for all the liquid droplets are easily determined even when the liquid droplets of the two or more kinds of radiation curable ink compositions are ejected onto a recording medium.

A difference ($\Delta E_{90}$) of ($E_{90}$) [mJ/cm$^2$] between the two or more kinds of radiation curable ink compositions can be represented by Equation (2) using Equation (1) above.

$$0 \leq \Delta E_{90} \leq 8(n-1)E/3 \quad (2)$$

(In Equation (2), $n$ represents an integer of 2 or more.)

The radiation curable ink compositions are sometimes different in the total irradiation energy required for curing depending on the contained materials. Therefore, when the irradiation energy per irradiation carried out by the irradiation measures E [mJ/cm$^2$] and the number of passes n for forming a given image are determined, the irradiation conditions of the active radiation suitable for all the liquid droplets can be easily determined and a favorable image can be obtained even when the liquid droplets of the two or more kinds of radiation curable ink compositions are ejected onto the recording medium.

The difference ($\Delta E_{90}$) of ($E_{90}$) [mJ/cm$^2$] between the two or more kinds of radiation curable ink compositions for use in the image forming method of this embodiment is more preferably within 70 [mJ/cm$^2$].

When the difference ($\Delta E_{90}$) of ($E_{90}$) [mJ/cm$^2$] between the two or more kinds of radiation curable ink compositions is within 70 [mJ/cm$^2$], the irradiation conditions of the active radiation suitable for all the liquid droplets can be more easily determined and a favorable image can be obtained even when the liquid droplets of the two or more kinds of radiation curable ink compositions are ejected onto the recording medium.

3. Third Embodiment

An ink jet recording device according to this embodiment has; an ejection head that ejects liquid droplets of a radiation curable ink composition onto a recording medium; and an active radiation irradiation device that irradiates the liquid droplets with active radiation, in which the ink jet recording device has a control measure for controlling a difference of the total irradiation energy of a liquid droplet having the highest total irradiation energy, of the active radiation and a liquid droplet having the lowest total irradiation energy of the active radiation among the liquid droplets of the radiation curable ink composition irradiated with the active radiation to 30% or more and 50% or lower of the irradiation energy ($E_{90}$) [mJ/cm$^2$] required for curing 90% of the radiation curable ink composition.

For the ink jet recording device according to this embodiment, the ink jet recording device 20 described in the first embodiment can be used, for example. Hereinafter, the ink jet recording device in this embodiment will be described with reference to the ink jet recording device 20 described above and the description of the same components and the same functions as those in the first embodiment is omitted.

The ink jet recording device according to this embodiment has a control measure. As the control measure, a control circuit (not illustrated) mounted on the ink jet recording device 20 can be used. The control circuit controls the difference of the total irradiation energy of a liquid droplet having the highest total irradiation energy of the active radiation and a Liquid droplet having the lowest total irradiation energy of the active radiation to be 30% or more and 50% or lower of the irradiation energy ($E_{90}$) [mJ/cm$^2$] required for curing 90% of the radiation curable ink composition.

Specifically, the control circuit can control the number of passes for forming a given image when the irradiation energy emitted from the active radiation irradiation device 90A (90B) is set beforehand.

In contrast, when the number of passes for forming a given image is determined beforehand, the irradiation energy of the active radiation irradiation device 90A (90B) can be controlled and light on and out of the active radiation irradiation device 90A (90B) can be controlled using the above-described light source control circuit (not illustrated).

In the ink jet recording device 20 according to this embodiment, the difference of the total irradiation energy of a liquid droplet having the highest total irradiation energy of the active radiation and a liquid droplet having the lowest total irradiation energy of the active radiation is controlled to be 30% or more and 50% or lower of the irradiation energy ($E_{90}$) [mJ/cm$^2$] required for curing 90% of the radiation curable ink composition. Therefore, the ink jet recording device 20 according to this embodiment can record an image in which the glossiness is excellent, image bleeding can be reduced, and the color density is high.

Furthermore, the ink jet recording device described in the second embodiment may be used in the third embodiment. In this case, by setting the number of passes or controlling the irradiation energy of the active radiation irradiation device 90A (90B) in such a manner that the difference ($\Delta E_{90}$) of $E_{90}$ between the two or more kinds of radiation curable ink compositions satisfies the relationship of Equation (2) above in addition to the above description, an image in which the glossiness is excellent, image bleeding can be reduced, and the color density is high can be recorded.

4. Fourth Embodiment

A recorded material according to one embodiment of the invention is recorded by the image forming method described above. Since the image recorded on the recording medium is recorded by the image forming method described above, bleeding hardly occurs, the image glossiness is excellent, and the color density is high.

5. Other Embodiments

In each embodiment above, the image is formed by so-called bidirectional image formation in which the image is formed by main scanning in which the ejection head 52, having light sources (190A, 190*b*) on both sides in a given direction, moves back and forth in both directions along the given direction. However, the image formation method is not limited to the above and so-called single direction image formation in which the image is formed by ejecting liquid droplets by main scanning of the ejection head 52, having a light source at only one side in the given direction, in one direction (direction opposite to the one side) in the given direction may be performed. In this case, when moving the ejection head 52 in a direction opposite to the given direction in which main scanning is performed, an operation of returning the ejection head 52 to the original position is performed without ejecting liquid droplets. Also in this case, since the liquid droplets are irradiated by one light source provided at one side in the given direction of the ejection head 52 with the returning operation of the ejection head 52, the total irradiation energy Ei of the liquid Li with the highest total irradiation energy satisfies Equation (A). In this case, the irradiation to the liquid droplets with the returning operation is also included in the second process described above.

6. Examples

Hereinafter, the invention will be more specifically described with reference to Examples but is not limited thereto.

6.1. Preparation of Pigment Dispersion Liquid

Phenoxyethyl acrylate (manufactured by Osaka Organic Chemical Industry, LTD., Trade name "V#192") as a monofunctional monomer was added to 18 parts by mass of a black pigment (manufactured by Ciba Specialty Chemicals Inc., Trade name "MICROLITH-WA Black C-WA") as a colorant and 1.2 parts by mass of Solsperse36000 (manufactured by LUBRIZOL) as a dispersant to be 100 parts by mass in total, and then mixed and stirred to obtain a mixture. The mixture was dispersed with zirconia beads (1.5 mm in diameter) for 6 hours using a sand mill (manufactured by Yasukawa Seisakusho K.K.). Thereafter, the zirconia beads were separated with a separator, thereby obtaining a black pigment dispersion liquid. Similarly, a cyan pigment dispersion liquid, a magenta pigment dispersion liquid, and a yellow pigment dispersion liquid were obtained.

6.2. Preparation of Radiation Curable Ink Composition

Polymerizable compounds, photopolymerization initiators, slipping agents, and polymerization inhibitors were mixed and completely dissolved in such a manner as to achieve the formulations (% by mass) shown in Table 1. Thereafter, the black pigment dispersion liquid was added dropwise under stirring in such a manner that the concentration of the black pigment becomes the concentration shown in Table 1. After the completion of dropwise addition, the mixture was mixed and stirred at room temperature for 1 hour, and then filtered with a 5 μm membrane filter, thereby obtaining a black radiation curable ink composition. Similarly, a cyan radiation curable ink composition, a magenta radiation curable ink composition, and a yellow radiation curable ink composition were obtained.

The components used in Table 1 are as follows.

(1) Polymerizable Compound
- Phenoxy acrylate (Osaka Organic Chemical Industry, Co. LTD., Trade name "V#192")
- Dicyclopentenyloxyethyl acrylate (manufactured by Hitachi Chemical Co., Ltd., Trade name "FA512AS")
- Dicyclopentenyl acrylate (manufactured by Hitachi Chemical Co., Ltd., Trade name "FA511AS")
- N-vinyl caprolactam (manufactured by BASF A.G., Trade name "N-vinyl caprolactam")
- Aminoacrylate (manufactured by Daicel Cytec Company Ltd., Trade name "EBECRYL 7100")
- Tripropylene glycol diacrylate (manufactured by Shin-Nakamura Chemical Co., Ltd., Trade name "APG-200")
- Dipropyrene glycol diacrylate (manufactured by Shin-Nakamura Chemical Co., Ltd., Trade name "APG-100")

(2) Polymerization Inhibitor
- p-methoxyphenol (manufactured by Kanto Chemical Co., Ltd.)

(3) Slipping Agent
- BYK-UV3500 (manufactured by BYK-Chemie Japan K.K., polydimethyl siloxane having a polyether-modified acrylic group)

(4) Photopolymerization Initiator
- IRGACURE 819 (manufactured by Ciba Japan Inc., bis(2,4,6-trimethylbenzoyl)-phenylphosphine oxide, photopolymerization initiator)
- DAROCUR TPO (manufactured by Ciba Japan Inc., 2,4,6-trimethylbenzoyl-diphenyl-phosphine oxide, photopolymerization initiator)
- DETX (manufactured by Nippon Kayaku Co., Ltd., photopolymerization initiator)

(5) Dispersant
- Solsperse36000 (manufactured by LUBRIZOL)

(6) Pigment
- MICROLITH-WA Black C-WA (manufactured by Ciba Specialty Chemicals Inc., black pigment)
- IRCALITE BLUE GLVO (manufactured by Ciba Specialty Chemicals Inc., cyan pigment)
- CROMOPHTAL PinkPT (SA) GLVO manufactured by Ciba Specialty Chemicals Inc., magenta pigment
- IRGALITE YELLOW LBG manufactured by Ciba Specialty Chemicals Inc., yellow pigment 6.3. Measurement of $E_{90}$ of Radiation Curable Ink Composition The irradiation energy ($E_{90}$) [mJ/cm$^2$] of active radiation required for curing 90% of a radiation curable ink composition was measured using FT-IR (manufactured by Thermo Fisher Scientific K.K., Trade name "MAGNA-IR 860 Nicolet") from the peak (810 cm$^{-1}$) of the absorption spectrum of a vinyl group of each radiation curable ink composition before and after irradiation of active radiation.

Specifically, first, the peak height $A_o$ at 810 $cm^{-1}$ before irradiation and the peak height $A_t$ at 810 $cm^{-1}$ after irradiation were determined from the IR spectrum, and the curing rate was calculated using Equation (3).

$$\text{Curing rate (\%)}=100\times(1-A_t/A_o) \quad (3)$$

Thus, the irradiation energy ($E_{90}$) [mJ/$cm^2$] of the active radiation when the curing rate of the radiation curable ink composition became 90%. The $E_{90}$ value of each of the obtained radiation curable ink compositions is shown in Table 1.

The measurement of the irradiation energy of the radiation curable ink compositions was performed in a state where the distance from a UV-LED (same as one used in Example described later) to the radiation curable ink composition was made the same as the distance from a UV-LED in a ultraviolet irradiation device in Example described later to a recording medium. Then, the radiation curable ink composition was irradiated with the above-described UV-LED with an active peak wavelength of 395 nm, and the irradiation energy of the radiation curable ink composition was measured. The irradiation energy [mJ/$cm^2$] was measured from the product of the irradiation intensity [mW/$cm^2$] on the irradiated surface irradiated by the UV-LED, which was separately measured, and the irradiation duration time [s]. The measurement of the irradiation intensity was performed by a ultraviolet ray intensity meter UM-10 and a light receiving portion UM-400 (manufactured by Konica Minolta Sensing, Inc.).

rays were emitted to the entire solid pattern image so that the total quantity of light was 400 mJ/$cm^2$ or more to perform curing treatment for completely curing the solid pattern image. The printing conditions were as follows: Resolution of 720×720 dpi and Liquid droplet amount of 14 pl.

As described above, a recorded material on which the solid pattern image was printed on the PET film so that each color of CMYK contacted was produced.

(2) Production of Recorded Material Under Fixed Irradiation Intensity

The radiation curable ink compositions were charged for each color in each nozzle row using an ink jet printer PX-G5000 (manufactured by Seiko Epson Corporation). Next, liquid droplets were ejected onto a PET film under room temperature and normal Pressure so that each color of CMYK contacted and the liquid droplets were irradiated with 395 nm ultraviolet rays of an irradiation intensity of 6 mW/$cm^2$ from UV-LEDs in ultraviolet irradiation devices mounted on both sides of a carriage, and then the PET film was transported in the sub-scanning direction.

Such operation was performed two or more times (two or more passes) to thereby form a solid pattern image on the PET film. Then, ultraviolet rays were emitted to the entire solid pattern image so that the total quantity of light was 400 mJ/$cm^2$ or more to perform curing treatment for completely curing the solid pattern image. The printing conditions were as follows: Resolution of 720×720 dpi and Liquid droplet amount of 14 pl.

TABLE 1

| Radiation curable ink composition | | Black (K) | Cyan (C) | Magenta (M) | Yellow (Y) |
|---|---|---|---|---|---|
| (1) Polymerizable compound (% by mass) | Phenoxyethyl acrylate | 30.50 | 41.50 | 38.50 | 29.50 |
| | Dicyclopentenyloxyethyl acrylate | 10.00 | 20.00 | 20.00 | 20.00 |
| | Dicyclopentenyl acrylate | — | 10.00 | 15.00 | 20.00 |
| | N-vinyl caprolactam | 10.00 | 10.00 | 10.00 | 5.00 |
| | Tripropylene glycol diacrylate | 20.00 | — | — | — |
| | Dipropylene glycol diacrylate | 10.00 | — | — | — |
| | Aminoacrylate | 3.00 | 5.00 | — | 5.00 |
| (2) Polymerization inhibitor (% by mass) | p-methoxyphenol | 0.20 | 0.20 | 0.20 | 0.20 |
| (3) Slipping agent (% by mass) | BYK-UV3500 | 0.10 | 0.10 | 0.10 | 0.10 |
| (4) Photopolymerization initiator (% by mass) | Irgacure819 | 6.00 | 6.00 | 6.00 | 6.00 |
| | DAROCURE TPO | 5.00 | 4.00 | 4.00 | 4.00 |
| | DETX-S | 2.00 | 1.00 | 1.00 | 2.00 |
| (5) Dispersant (% by mass) | Solsperse3600 | 0.20 | 0.20 | 0.20 | 0.20 |
| (6) Pigment (% by mass) | MICROLITH-WA Black C-WA | 3.00 | — | — | — |
| | IRGALITE BLUE GLVO | — | 2.00 | — | — |
| | CROMOPHTAL PinkPT(SA) GLVO | — | — | 5.00 | — |
| | IRGALITE YELLOW LBG | — | — | — | 8.00 |
| Total (% by mass) | | 100.00 | 100.00 | 100.00 | 100.00 |
| $E_{90}$ (mJ/$cm^2$) | | 250 | 200 | 180 | 222 |

6.4. Evaluation Test 6.4.1. Bleeding Properties Evaluation Test (1). Production of Recorded Material Under Fixed Path Conditions The radiation curable ink compositions were charged for each color in each nozzle row using an ink jet printer PX-G5000 (manufactured by Seiko Epson Corporation). Next, liquid droplets were ejected onto a PET film under room temperature and normal pressure so that each color of cyan (C), magenta (M), yellow (Y), and black (K) contacted and the liquid droplets were irradiated with 395 nm ultraviolet rays of an irradiation intensity in the range of 2 mW/$cm^2$ to 39 mW/$cm^2$ from UV-LEDs in ultraviolet irradiation devices mounted on both sides of a carriage, and then the PET film was transported in the sub-scanning direction.

Such operation was performed 5 times (5 passes) to thereby form a solid pattern image on the PET film. Then, ultraviolet As described above, a recorded material on which the solid pattern image was printed on the PET film so that each color of CMYK contacted was produced.

(3) Evaluation Method of Recorded Material

The obtained recorded materials were observed and evaluated bleeding in the contact portion with other colors for each color for. The evaluation criteria are classified as follows.

A: No bleeding to other colors is observed.

B: Bleeding to other color is slightly observed.

C: Bleeding to other colors is observed.

6.4.2. Glossy Evaluation Test (1) Production of Recorded Material Under Fixed Pass Conditions The radiation curable ink compositions were charged for each color in each nozzle row using an ink jet printer PX-G5000 (manufactured by Seiko Epson Corporation). Next, liquid droplets were ejected onto a PET film under room temperature and normal pressure and the liquid droplets were irradiated with 395 nm ultraviolet rays of an irradiation intensity in the range of 1.5 mW/cm$^2$ to 39 mW/cm$^2$ from UV-LEDs in ultraviolet irradiation devices mounted on both sides of a carriage, and then the PET film was transported in the sub-scanning direction.

Such operation was performed 5 times (five pass) to thereby form a solid pattern image of a single color on the PET film. Then, ultraviolet rays were emitted to the entire solid pattern image so that the total quantity of light was 400 mJ/cm$^2$ or more to perform curing treatment for completely curing the solid pattern image. The printing conditions were as follows: Resolution of 720×720 dpi and Liquid droplet amount of 14 pl.

As described above, a recorded material on which the solid pattern image of a single color was printed on the PET film was produced.

(2) Production of Recorded Material Under Fixed Irradiation Intensity

The radiation curable ink compositions were charged for each color in each nozzle row using an ink jet printer PX-G5000 (manufactured by Seiko Epson Corporation). Next, liquid droplets were ejected onto a PET film under room temperature and normal pressure and the liquid droplets were irradiated with 395 nm ultraviolet rays of an irradiation intensity of 6 mW/cm$^2$ from UV-LEDs in ultraviolet irradiation devices mounted on both sides of a carriage, and then the PET film was transported in the sub-scanning direction.

Such operation was performed two or more times (two or more passes) to thereby form a solid pattern image on the PET film. Then, ultraviolet rays were emitted to the entire solid pattern image so that the total quantity of light was 400 mJ/cm$^2$ or more to perform curing treatment for completely curing the solid pattern image. The printing conditions were as follows: Resolution of 720×720 dpi and Liquid droplet amount of 14 pl.

As described above, a recorded material on which the solid pattern image of a single color was printed on the PET film was produced.

(3) Evaluation Method of Recorded Material

The specular gloss at 60° of the obtained image was measured using a gloss meter MULTI Gloss 268 (manufactured by Konica Minolta Co., Ltd.) based on JIS Z8741. The evaluation criteria of the glossiness of the obtained image are as follows, and gloss is accepted in the image evaluated as B or higher.

A: Glossiness of 70 or more
B: Glossiness of 50 or more and lower than 70
C: Glossiness of 30 or more and lower than 50
D: Glossiness of lower than 30

6.4.3. Evaluation Test of Color Density

The images obtained in "5.4.2. Glossiness evaluation test" above were measured for the optical density (OD value) using a colorimeter (trade name: Spectrolino, manufactured by GretagMacbeth). The evaluation criteria of the obtained images are as follows.

OD value of 1.8 or more: Color density is high and color development is good.

OD value of lower than 1.8: Color density is low and color development is poor.

6.5. Evaluation Results

The evaluation results were shown in Tables 2 to 7. The recorded materials of Tables 2 to 4 were produced in a state where the number of passes was fixed to 5 passes and the irradiation intensity of UV emitted from the ultraviolet irradiation devices was changed. The recorded materials of Tables 5 to 7 were produced in a state where the irradiation intensity of the ultraviolet irradiation devices was fixed to 6 mJ/cm$^2$ and the number of passes was changed.

In Tables 2 to 7, Ei represents the total irradiation energy (mJ/cm$^2$) of a liquid droplet with the highest total irradiation energy of UV emitted from the UV-LEDs in the ultraviolet irradiation devices mounted on both sides of the carriage. Ef represents the total irradiation energy (mJ/cm$^2$) of a liquid droplet with the lowest total irradiation energy of UV emitted from the UV-LEDs in the ultraviolet irradiation devices mounted on both sides of the carriage.

From the evaluation results of Tables 2 to 7, recording of favorable images using the radiation curable ink composition of each Example can be achieved by performing image recording according to the first embodiment using the conditions of any one of Examples 1 to 25. Thus, favorable images can be recorded by setting the number of passes n, the irradiation energy E per irradiation, and the irradiation energy $E_{90}$ required for curing 90% of the radiation curable ink composition in such a manner as to establish a preferable relationship.

From the evaluation results of Tables 2 to 7, recording of favorable color images using two or more kinds of radiation curable ink compositions can be achieved by performing image recording according to the second embodiment using the conditions of Examples 3, 5, 6, and 10 or the conditions of Examples 14, 16, 19, and 24. Thus, favorable images can be recorded by setting the number of passes n, the irradiation energy E per irradiation, and the difference of $E_{90}$ ($\Delta E_{90}$) of the two or more of radiation curable ink compositions in such a manner as to establish a preferable relationship.

In the third embodiment described above, the setting of the number of passes n or the control of the irradiation energy per irradiation to satisfy Equation (1) or Equation (2) above, but the selection of radiation curable ink compositions having $E_{90}$ satisfying Equation (1) or Equation (2) may be performed.

TABLE 2

| | | Example 1 | Example 2 | Example 3 | Example 4 | Example 5 | Example 6 | Example 7 | Example 8 | Example 9 | Example 10 |
|---|---|---|---|---|---|---|---|---|---|---|---|
| Radiation curable ink composition type | | K | K | K | C | C | M | M | Y | Y | Y |
| Ei (mJ/cm$^2$) | | 126 | 108 | 90 | 108 | 90 | 90 | 63 | 126 | 108 | 90 |
| Ef (mJ/cm$^2$) | | 14 | 12 | 10 | 12 | 10 | 10 | 7 | 14 | 12 | 10 |
| (Ei − Ef)/$E_{90}$ (%) | | 45 | 38 | 32 | 48 | 40 | 44 | 31 | 50 | 43 | 36 |
| Evaluation results | Bleeding | ○ | ○ | ○ | ○ | ○ | ○ | ○ | ○ | ○ | ○ |
| | Gloss | B | A | A | B | B | B | B | B | A | A |
| | Color density | 1.93 | 2.01 | 1.94 | 1.84 | 1.84 | 1.82 | 1.81 | 1.91 | 1.96 | 2.01 |

TABLE 3

| | | Comparative Example 1 | Comparative Example 2 | Comparative Example 3 | Comparative Example 4 | Comparative Example 5 | Comparative Example 6 | Comparative Example 7 |
|---|---|---|---|---|---|---|---|---|
| Radiation curable ink composition type | | K | K | K | K | K | K | C |
| Ei (mJ/cm$^2$) | | 351 | 216 | 189 | 153 | 63 | 18 | 351 |
| Ef (mJ/cm$^2$) | | 39 | 24 | 21 | 17 | 7 | 2 | 39 |
| (Ei − Ef)/$E_{90}$ (%) | | 125 | 77 | 67 | 54 | 22 | 6 | 156 |
| Evaluation results | Bleeding | ○ | ○ | ○ | ○ | X | ○ | ○ |
| | Gloss | D | C | C | C | B | C | D |
| | Color density | 1.85 | 1.91 | 1.94 | 1.93 | 1.70 | 1.52 | 1.52 |

| | | Comparative Example 8 | Comparative Example 9 | Comparative Example 10 | Comparative Example 11 | Comparative Example 12 | Comparative Example 13 |
|---|---|---|---|---|---|---|---|
| Radiation curable ink composition type | | C | C | C | C | C | C |
| Ei (mJ/cm$^2$) | | 216 | 189 | 153 | 126 | 63 | 18 |
| Ef (mJ/cm$^2$) | | 24 | 21 | 17 | 14 | 7 | 2 |
| (Ei − Ef)/$E_{90}$ (%) | | 96 | 84 | 68 | 56 | 28 | 8 |
| Evaluation results | Bleeding | ○ | ○ | ○ | ○ | Δ | X |
| | Gloss | D | D | D | C | B | A |
| | Color density | 1.60 | 1.68 | 1.71 | 1.80 | 1.87 | 1.87 |

TABLE 4

| | | Comparative Example 14 | Comparative Example 15 | Comparative Example 16 | Comparative Example 17 | Comparative Example 18 | Comparative Example 19 | Comparative Example 20 |
|---|---|---|---|---|---|---|---|---|
| Radiation curable ink composition type | | M | M | M | M | M | M | M |
| Ei (mJ/cm$^2$) | | 351 | 216 | 189 | 153 | 126 | 108 | 18 |
| Ef (mJ/cm$^2$) | | 39 | 24 | 21 | 17 | 14 | 12 | 2 |
| (Ei − Ef)/$E_{90}$ (%) | | 173 | 107 | 93 | 76 | 62 | 53 | 9 |
| Evaluation results | Bleeding | ○ | ○ | ○ | ○ | ○ | ○ | Δ |
| | Gloss | D | D | D | D | D | C | A |
| | Color density | 1.44 | 1.59 | 1.60 | 1.67 | 1.73 | 1.77 | 1.80 |

| | | Comparative Example 21 | Comparative Example 22 | Comparative Example 23 | Comparative Example 24 | Comparative Example 25 | Comparative Example 26 |
|---|---|---|---|---|---|---|---|
| Radiation curable ink composition type | | Y | Y | Y | Y | Y | Y |
| Ei (mJ/cm$^2$) | | 351 | 216 | 189 | 153 | 63 | 18 |
| Ef (mJ/cm$^2$) | | 39 | 24 | 21 | 17 | 7 | 2 |
| (Ei − Ef)/$E_{90}$ (%) | | 141 | 86 | 76 | 61 | 25 | 7 |
| Evaluation results | Bleeding | ○ | ○ | ○ | ○ | X | X |
| | Gloss | D | D | C | C | B | C |
| | Color density | 1.75 | 1.77 | 1.81 | 1.85 | 2.04 | 1.91 |

TABLE 5

| | | Example 11 | Example 12 | Example 13 | Example 14 | Example 15 | Example 16 | Example 17 | Example 18 |
|---|---|---|---|---|---|---|---|---|---|
| Radiation curable ink composition type | | K | K | K | K | C | C | C | C |
| Number of passes (pass) | | 11 | 10 | 9 | 8 | 9 | 8 | 7 | 6 |
| Ei (mJ/cm$^2$) | | 126 | 114 | 102 | 90 | 102 | 90 | 78 | 66 |
| Ef (mJ/cm$^2$) | | 6 | 6 | 6 | 6 | 6 | 6 | 6 | 6 |
| (Ei − Ef)/$E_{90}$ (%) | | 48 | 43 | 38 | 34 | 48 | 42 | 36 | 30 |
| Evaluation results | Bleeding | ○ | ○ | ○ | ○ | ○ | ○ | ○ | ○ |
| | Gloss | B | B | A | A | B | B | B | B |
| | Color density | 1.91 | 1.93 | 2.00 | 1.94 | 1.82 | 1.82 | 1.84 | 1.85 |

TABLE 5-continued

| | | Example 19 | Example 20 | Example 21 | Example 22 | Example 23 | Example 24 | Example 25 |
|---|---|---|---|---|---|---|---|---|
| Radiation curable ink composition type | | M | M | M | Y | Y | Y | Y |
| Number of passes (pass) | | 8 | 7 | 6 | 10 | 9 | 8 | 7 |
| Ei (mJ/cm$^2$) | | 90 | 78 | 66 | 114 | 102 | 90 | 78 |
| Ef (mJ/cm$^2$) | | 6 | 6 | 6 | 6 | 6 | 6 | 6 |
| (Ei − Ef)/$E_{90}$ (%) | | 47 | 40 | 33 | 49 | 43 | 38 | 32 |
| Evaluation results | Bleeding | ○ | ○ | ○ | ○ | ○ | ○ | ○ |
| | Gloss | B | B | B | B | A | A | A |
| | Color density | 1.82 | 1.82 | 1.81 | 1.90 | 1.95 | 2.02 | 2.01 |

15

TABLE 6

| | | Comparative Example 27 | Comparative Example 28 | Comparative Example 29 | Comparative Example 30 | Comparative Example 31 |
|---|---|---|---|---|---|---|
| Radiation curable ink composition type | | K | K | K | K | K |
| Number of passes (pass) | | 13 | 12 | 7 | 6 | 5 |
| Ei (mJ/cm$^2$) | | 150 | 138 | 78 | 66 | 54 |
| Ef (mJ/cm$^2$) | | 6 | 6 | 6 | 6 | 6 |
| (Ei − Ef)/$E_{90}$ (%) | | 58 | 53 | 29 | 24 | 19 |
| Evaluation results | Bleeding | ○ | ○ | Δ | X | X |
| | Gloss | C | C | B | B | C |
| | Color density | 1.92 | 1.91 | 1.90 | 1.72 | 1.63 |

| | | Comparative Example 32 | Comparative Example 33 | Comparative Example 34 | Comparative Example 35 | Comparative Example 36 |
|---|---|---|---|---|---|---|
| Radiation curable ink composition type | | C | C | C | C | C |
| Number of passes (pass) | | 13 | 12 | 11 | 10 | 5 |
| Ei (mJ/cm$^2$) | | 150 | 138 | 126 | 114 | 54 |
| Ef (mJ/cm$^2$) | | 6 | 6 | 6 | 6 | 6 |
| (Ei − Ef)/$E_{90}$ (%) | | 72 | 66 | 60 | 54 | 24 |
| Evaluation results | Bleeding | ○ | ○ | ○ | ○ | Δ |
| | Gloss | D | D | C | C | B |
| | Color density | 1.70 | 1.72 | 1.77 | 1.80 | 1.87 |

TABLE 7

| | | Comparative Example 37 | Comparative Example 38 | Comparative Example 39 | Comparative Example 40 | Comparative Example 41 | Comparative Example 42 |
|---|---|---|---|---|---|---|---|
| Radiation curable ink composition type | | M | M | M | M | M | M |
| Number of passes (pass) | | 13 | 12 | 11 | 10 | 9 | 5 |
| Ei (mJ/cm$^2$) | | 150 | 138 | 126 | 114 | 102 | 54 |
| Ef (mJ/cm$^2$) | | 6 | 6 | 6 | 6 | 6 | 6 |
| (Ei − Ef)/$E_{90}$ (%) | | 80 | 73 | 67 | 60 | 53 | 27 |
| Evaluation results | Bleeding | ○ | ○ | ○ | ○ | ○ | ○ |
| | Gloss | D | D | D | D | C | B |
| | Color density | 1.62 | 1.69 | 1.71 | 1.71 | 1.76 | 1.81 |

| | | Comparative Example 43 | Comparative Example 44 | Comparative Example 45 | Comparative Example 46 | Comparative Example 47 |
|---|---|---|---|---|---|---|
| Radiation curable ink composition type | | Y | Y | Y | Y | Y |
| Number of passes (pass) | | 13 | 12 | 11 | 6 | 5 |

TABLE 7-continued

| | | | | | | |
|---|---|---|---|---|---|---|
| Ei (mJ/cm$^2$) | | 150 | 138 | 126 | 66 | 54 |
| Ef (mJ/cm$^2$) | | 6 | 6 | 6 | 6 | 6 |
| (Ei − Ef)/$E_{90}$ (%) | | 65 | 59 | 54 | 27 | 22 |
| Evaluation results | Bleeding | ○ | ○ | ○ | X | X |
| | Gloss | C | C | C | B | B |
| | Color density | 1.83 | 1.85 | 1.86 | 2.04 | 2.00 |

The recorded materials of Examples 1 to 25 produced by the image forming method shown in Tables 2 and 5 were confirmed that bleeding with other colors does not occur, the glossiness is excellent, and the color density is high.

The evaluation results of Table 2 showed that, by setting the irradiation intensity of the irradiation device so that the difference between Ei and Ef is a value of 30% or more and 50% or lower of $E_{90}$ in the device in which the number of passes is fixed when forming a given image, recorded materials having favorable images are obtained.

The evaluation results of Table 5 showed that, by setting the number of passes so that the difference between Ei and Ef is a value of 30% or more and 50% or lower of $E_{90}$ when the irradiation intensity of the radiation irradiation device was set beforehand, recorded materials having favorable images are obtained.

The recorded materials of Examples 3, 5, 6, and 10 of Table 2 were produced in a state where the irradiation intensity of the ultraviolet irradiation devices was made the same and have favorable images. Thus, it was shown that even when different irradiation intensities are not set for each of two or more radiation curable ink compositions, the irradiation intensity with which all the radiation curable ink compositions can commonly form favorable images can be set.

Similarly as in the recorded materials of Examples 14, 16, 19, and 24 of Table 5, even when different irradiation intensities are not set for each of two or more radiation curable ink compositions, the same irradiation intensity with which all the radiation curable ink compositions can commonly form favorable images can be set.

In the recorded materials of Comparative Examples 1 to 47 produced by the image forming method of Tables 3 to 4 and 6 to 7 , the difference of Ei and Ef was outside the range of 30% or more and 50% or lower of $E_{90}$, and thus at least one of bleeding with other colors, glossiness, and color density was not favorable.

What is claimed is:

1. An image forming method, comprising:

a first process for ejecting liquid droplets of a radiation curable ink composition onto a recording medium from an ejection head capable of ejecting the radiation curable ink composition using an ink jet recording device; and a second process for irradiating the liquid droplets with active radiation by an irradiation measure capable of emitting the active radiation, wherein among the liquid droplets of the radiation curable ink composition irradiated with the active radiation, the second process satisfies the equation:

$$0.3 \leq (E_i - E_f)/E_{90} \leq 0.5$$

wherein $E_i$ the amount of energy of a liquid droplet having the highest total irradiation energy, $E_f$ is the amount of energy of a liquid droplet having the lowest total irradiation energy, and $E_{90}$ is the amount of energy required for curing 90% of the radiation curable ink composition.

2. An image forming method, comprising:

a first process for ejecting liquid droplets of two or more kinds of radiation curable ink compositions onto a recording medium from an ejection head capable of ejecting the radiation curable ink compositions using an ink jet recording device; and a second process for irradiating the liquid droplets with active radiation by an irradiation measure capable of emitting the active radiation, wherein in the two or more kinds of radiation curable ink compositions, the second process satisfies the equation $0.3 \leq (E_i - E_f)/E_{90} \leq 0.5$ for each of the two or more kinds of radiation curable ink, where $E_i$ is the amount of energy of a liquid droplet having the highest total irradiation engery, $E_f$ is the amount of energy of a liquid droplet having the lowest total irradiation energy, and $E_{90}$ is the amount of energy required for curing 90% of the radiation curable ink composition.

3. The image forming method according to claim 1, wherein the first process and the second process are performed while the ejection head is moving along a given direction; and the irradiation measure is provided on at least one side in the given direction of the ejection head.

4. The image forming method according to claim 1, wherein among the liquid droplets of the radiation curable ink composition irradiated with the active radiation, the liquid droplet having the highest total radiation energy of the active radiation is the liquid droplet that has been irradiated the highest number of times by the irradiation measure, and the liquid droplet having the lowest total irradiation energy of the active radiation is the liquid droplet that has been irradiated the least number of times by the irradiation measure.

5. The image forming method according to claim 1, wherein $E_{90}$ satisfies the equation: $4(n-1)E \leq E_{90} \leq 20(n-1)E/3$; where E is defined as the irradiation energy per scan carried out by the irradiation measure, and n is defined as the number of scans in the main scanning direction and where n represents an integer of 2 or more.

6. The image forming method according to claim 1, wherein the $E_{90}$ is 180 [mJ/cm$^2$] or more and 250 [mJ/cm$^2$] or lower.

7. The image forming method according to claim 2, wherein the equation $0 \leq \Delta E_{90} \leq 8(n-1)E/3$ is satisfied, wherein $\Delta E_{90}$ is a difference between the $E_{90}$ of two of the two or more kinds of radiation curable ink compositions, and n is the number of scans in the main scanning direction, where n represents an integer of 2 or more.

8. The image forming method according to claim 2, wherein the equation $0 \leq \Delta E_{90} \leq 70$ mJ/cm2 is satisfied, wherein $\Delta E_{90}$ is a difference between the $E_{90}$ of two of the two or more kinds of radiation curable ink compositions, and n is the number of scans in the main scanning direction, where n represents an integer of 2 or more.

9. The image forming method according to claim 1, wherein in the second process, the total irradiation energy emitted to the liquid droplet having the highest total irradiation energy of the active radiation and the total irradiation energy emitted to the liquid droplet having the lowest total irradiation energy of the active radiation each are lower than $E_{90}$.

10. An ink jet recording device, comprising:

an ejection head that ejects liquid droplets of a radiation curable ink composition onto a recording medium; and an active radiation irradiation device that irradiates the liquid droplets with active radiation, the ink jet recording device having:

a control measure for controlling the active irradiation radiation device to satisfy the equation:

$$0.3 \leq (E_i - E_f)/E_{90} \leq 0.5$$

wherein $E_i$ the amount of energy of a liquid droplet having the highest total irradiation energy, $E_f$ is the amount of energy of a liquid droplet having the lowest total irradiation energy, and $E_{90}$ is the amount of energy required for curing 90% of the radiation curable ink composition.

* * * * *